United States Patent [19]

Takauchi et al.

[11] Patent Number: 4,658,744

[45] Date of Patent: Apr. 21, 1987

[54] CAM-USING ELECTRONIC CONTROL SEWING MACHINE

[75] Inventors: Mitsuyoshi Takauchi; Toshio Takeda, both of Yamagata, Japan

[73] Assignee: Happy Mishin Seizou Kabushiki Kaisha, Yamagata, Japan

[21] Appl. No.: 819,228

[22] Filed: Jan. 15, 1986

[30] Foreign Application Priority Data

Feb. 28, 1985 [JP] Japan ..... 60-40749
Apr. 10, 1985 [JP] Japan ..... 60-76037

[51] Int. Cl.[4] ..... D05B 3/02; D05B 3/06

[52] U.S. Cl. ..... 112/466; 112/448; 112/453

[58] Field of Search ..... 112/466, 465, 459, 453, 112/448, 449, 458, 454

[56] References Cited

U.S. PATENT DOCUMENTS 3,874,312 4/1975 Cook ..... 112/466
4,196,683 4/1980 Eguchi ..... 112/453 X
4,265,188 5/1981 Suzuki et al. ..... 112/448 X

*Primary Examiner*—Peter Nerbun
*Attorney, Agent, or Firm*—Burgess, Ryan & Wayne

[57] ABSTRACT

In the present invention, a timing pulley is moved to a start point position in which a start point switch is switched on or off by a pulse motor, the start point position is memorized in a memory of a control circuit, key codes of selected pattern selection switches are calculated, a driving step number of the pulse motor is calculated by cam position data of a selected pattern obtained by the key codes, the cam position data being previously memorized in a memory, and position data of pattern cam selected in the present time, the position data being memorized in a random access memory and a cam-follower is moved to the position of the selected pattern cam by driving the pulse motor.

4 Claims, 15 Drawing Figures

START POINT MOVING PROGRAM

FIG. 6

| PATTERN SELECTION SWITCH | KEY CODE K | ROM ADDRESS | PATTERN CAM POSITION DATA | PAT-TERN | DISPLAY LIGHT |
|---|---|---|---|---|---|
| SW1 | 0 | A | 0 | ----- | LE1 |
| SW2 | 1 | A+1 | 40 | | LE2 |
| SW3 | 2 | A+2 | 80 | | LE3 |
| SW4 | 3 | A+3 | 120 | | LE4 |
| SW5 | 4 | A+4 | 170 | | LE5 |
| SW6 | 5 | A+5 | 220 | | LE6 |
| SW7 | 6 | A+6 | 270 | | LE7 |
| SW8 | 7 | A+7 | 400 | | LE8 |
| SW9 | 8 | A+8 | 450 | | LE9 |
| SW10 | 9 | A+9 | 500 | | LE10 |
| SW11 | 10 | A+10 | 550 | | LE11 |
| SW12 | 11 | A+11 | 600 | | LE12 |
| SW13 | 12 | A+12 | 650 | | LE13 |
| SW14 | 13 | A+13 | 800 | | LE14 |
| SW15 | 14 | A+14 | 850 | | LE15 |
| SW16 | 15 | A+15 | 900 | | LE16 |
| SW17 | 16 | A+16 | 950 | | LE17 |
| SW18 | 17 | REPEAT SWITCH | | | LE18 |

CAM-USING ELECTRONIC CONTROL SEWING MACHINE

BACKGROUND OF THE INVENTION

The present invention relates to an cam-using electronic control sewing machine for selecting a stitch pattern or patterns by driving a pulse motor and for automatically sewing a button hole or holes.

It is known in the prior art that this kind of stitch pattern selecting machine uses a servomotor for driving a cam-follower of the stitch pattern cams (see the Japanese public inspection laid open Pat. No. 19250/1978).

Because the stitch pattern selecting machine, however, uses the servomotor, the difference voltage between the present position and the selected position of the cam-follower is detected by a potentiometer and is supplied to the servomotor as a feedback signal. Therefore, when the cam-follower comes near to a selected position, the difference voltage becomes small and consequently the servomotor is not smoothly driven and the cam-follower is not exactly moved to the selected position.

Therefore, in the prior art, for solving the inaccuracy of the positioning of the cam-follower, a projecting pin attached to the opposite side of the cam-follower is inserted between respective two teeth of a toothed bar or into the window of the position correcting board corresponding to the stitch pattern cams.

Also, the other stitch pattern selecting machine in the prior art uses an electric motor for driving a cam-follower of the stitch pattern cams (Japanese public inspection laid open Pat. No. 159047/1979).

This usual machine comprises a detector for detecting the position of the cam-follower, a counter for counting electric pulse signals generated by the detector and a comparator for comparing coded signals from an operated switch of the selection switches with the output signals of the counter. The electric motor is stopped by the accord signal from the comparator.

In the usual machine, the position signals of the cam-follower are fed back and are compared with the siganls of the selected switch of the selection switches and the electric motor is stopped by the accord siganl from the comparator. Therefore, the cams, the switches and the comparator for detecting the cam-follower are used and thus the composition of the usual machine is complex.

Also, usual automatic button hole stitch sewing device comprises a plurality of pattern cams for sewing each step of button hole stitches and means for memorizing the number of stitches by an electronic control device (Japanese public inspection laid open Pat. No. 12680/1983).

In the usual automatic button hole stitch sewing device, however, because left line tack stitches and right line tack stitches must be designated by pushing switches, the sewing operation is complex.

SUMMARY OF THE INVENTION

It is an object of the present invention to provide a cam-using electronic control sewing machine in which one or more of pattern selection cams are selected by a pulse motor without feedback of position signals.

It is another object of the present invention to provide a cam-using electronic control sewing machine in which bar tack stitches, left and right line tack stitches are automatically sewn without setting of the order for sewing their tack stitches.

It is another object of the present invention to provide a cam-using electronic control sewing machine which has a simple composition and is manufactured at low cost.

In order to accomplish the above and other objects, the present invention comprises a plurality of pattern cams rotated by a rotation of a main shaft, one or more cam-followers for contacting with said plurality of pattern cams, a needlebar guiderod and a needle bar connected with the moving of said cam-follower, a position setting device for setting positions of said cam-followers, a start point detecting device for detecting a start point of the cam position data of said pattern cams, a pulse motor for moving said cam-followers or said cams for selectively operating said cam-followers, a drive circuit for driving said pulse motor, a plurality of pattern select switches for generating one of proper key codes when one of sewing patterns is selected, a display device for displaying the selection of the one of said sewing patterns, a memory for previously memorizing data of the position set from said start point of the pattern cams, a random access memory for memorizing data of the position of the cam selected at present, and an operational unit for calculating the number of output pulse applied to said pulse motor by the cam position data selected at present in said random access memory and the proper key codes generated by said pattern selection switch, whereby said output pulses are applied to said pulse motor and the desired sewing patterns are selected.

These and other objects, features and advantages of the present invention will become more apparent from the following description taken in connection with the illustrated embodiment of the accompanying drawings.

BRIEF DESCRIPTION OF THE DRAWINGS

FIG. 6 shows data selected by the pattern selection switches.

DESCRIPTION OF THE PREFERRED EMBODIMENTS

Figure 1:
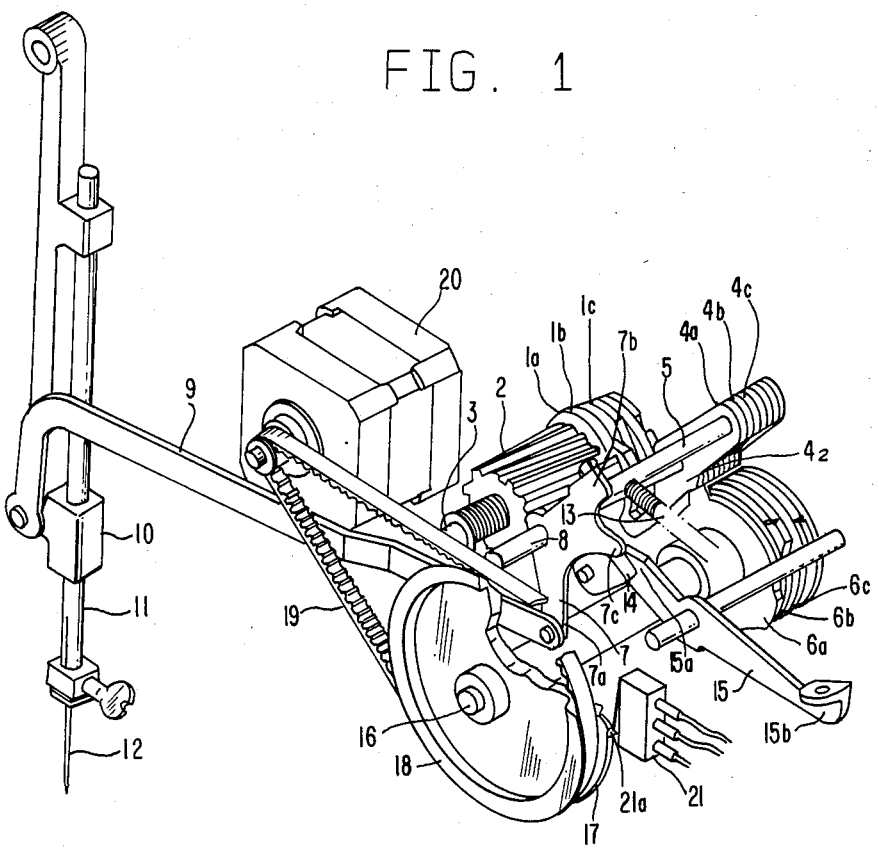
FIG. 1 shows a perspective view of a cam-using electronic control sewing machine of the first embodiment of the present invention.
Figure 2:
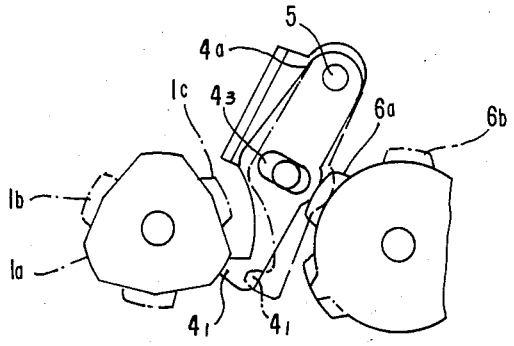
FIG. 2 shows a side view of the portion of the cams in FIG. 1.

Referring to FIG. 1 of the drawings, in the cam-using electronic control sewing machine according to the present invention, a plurality of pattern cams 1*a*, 1*b*, 1*c*, . . . and a worm wheel 2 are mounted on a shaft 3. The worm wheel 2 is geared by a worm mounted on a main shaft which is rotated by an electric motor of a sewing machine (not shown) and is rotated while the sewing machine is driven. There are provided cam-followers 4*a*, 4*b*, 4*c*, . . . corresponding to and near the plural cams 1*a*, 1*b*, 1*c*, . . . . The tops of the cam-followers 4*a*, 4*b*, 4*c*, . . . are respectively supported in free rotation. As shown in FIG. 2, the respective lower projections $4_1$ of cam-followers 4*a*, 4*b*, 4*c*, . . . are respectively contacted with the cams 1*a*, 1*b*, 1*c*, . . . . The projections $4_2$ near the respective centers of the cam-followers 4*a*, 4*b*, 4*c*, . . . opposite the side of the projections $4_1$ are contacted with the projections of pattern switching cams 6*a*, 6*b*, 6*c*, . . . . A rotary shaft 8 attached to the center of a Z-arm 7 is inserted into the slits $4_3$ in the respective centers of the cam-followers 4*a*, 4*b*, 4*c*, . . . . One end of a needlebar guide rod 9 is connected to the lower end 7*a* of the Z-arm 7 and the other end of the needlebar guide rod 9 is connected to a needlebar guide 10. A needlebar 11 is supported by the needlebar guide 10 and a needle 12 is attached to the needlebar 11. A spring 13 is connected to the upper end 7*b* of the Z-arm 7, thus the lower end 7*a* of the Z-arm 7 always pushes the needlebar guide rod 9. A stopper 14 attached to one end of a lever 15 is positioned near the central portion 7*c* of the Z-arm 7. When the other end 15*b* of the lever 15 is lowered, the stopper 14 is contacted with the central portion 7*c* of the Z-arm 7, the Z-arm 7 is lifted and the needlebar guide rod 9 connected to the lower end 7*a* of the Z-arm 7 and the needlebar guide 10 are moved toward the right side of FIG. 1. Also, the stopper 14 is released by lifting the other end 15*b* of the lever 15.

Figure 3:
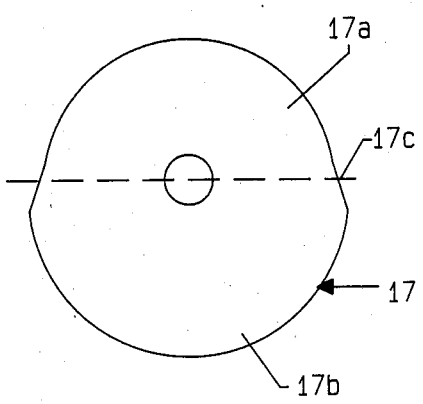
FIG. 3 shows a plane view of a start point switch cam.

On the one hand, a start point cam 17 and a timing pulley 18 are attached to a pattern switching shaft 16 of the pattern switching cams 6*a*, 6*b*, 6*c*, . . . and a timing belt 19 is suspended between the timing pulley 18 and the pulley of the shaft of a pulse motor. The start point cam 17 is constructed by a small diameter portion 17*a* and a large diameter portion 17*b* as shown in FIG. 3. The lever 21*a* of a start point switch 21 is positioned near the start point cam 17. When the lever 21*a* of the start point switch 21 is contacted with the large diameter portion 17*b* of the start point cam 17, the start point switch 21 is switched on and when the lever 21*a* of the start point switch 21 is contacted with the small diameter portion 17*a* of the start point cam 17, the start point switch 21 is switched off. The central portion 17*c* between the small diameter portion 17*a* and the large diameter portion 17*b* becomes a start position.

Figure 4:
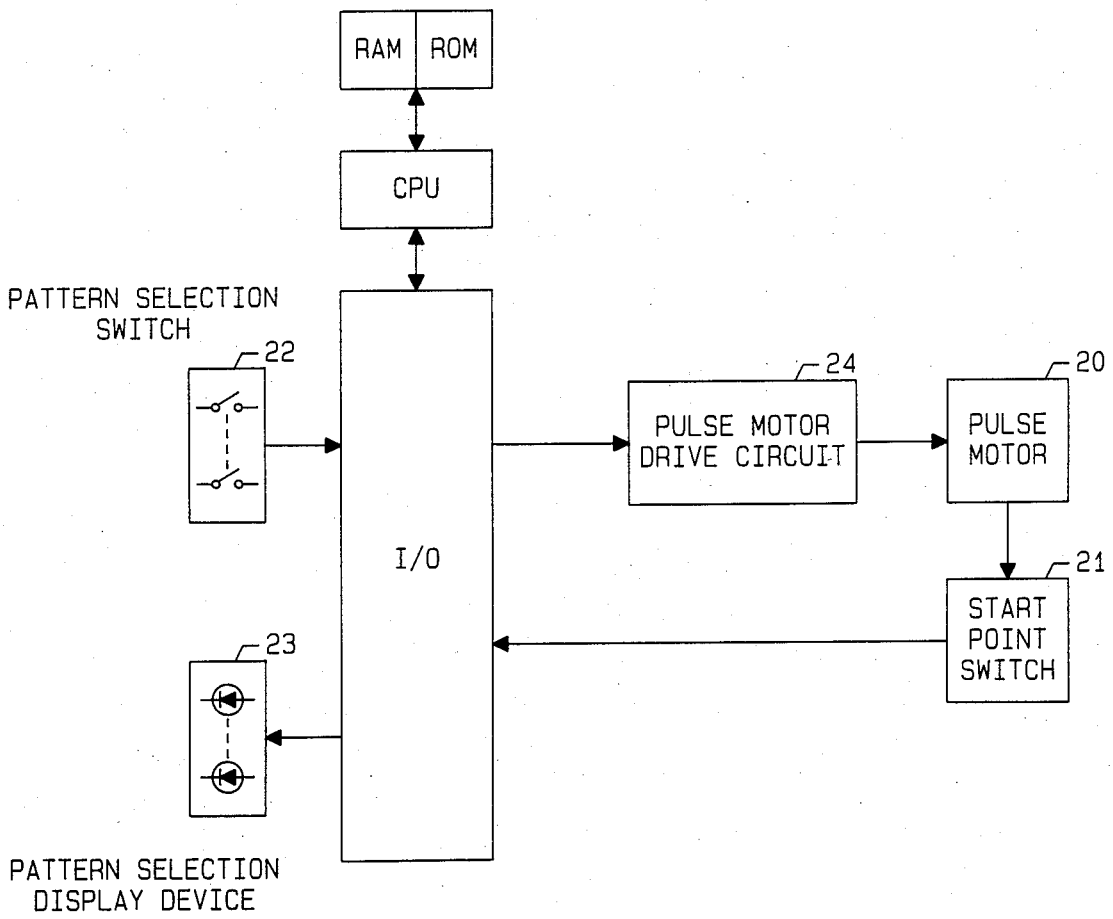
FIG. 4 shows a control circuit for controlling the motion of the cam-using electronic control sewing machine in FIG. 1.

Referring to FIG. 4, a control circuit according to the present invention uses a microcomputer having a read only memory ROM, a random access memory RAM, a central processing unit CPU and an input output port I/O. A pattern selection switch 22 and a pattern selection display device 23 mounted on the outside panel of the sewing machine are connected to the input output port I/O. Also a pulse motor driving circuit 24 for driving the pulse motor 20 and start point switch 21 shown in FIG. 1 are connected to the input output port I/O.

Figure 5:
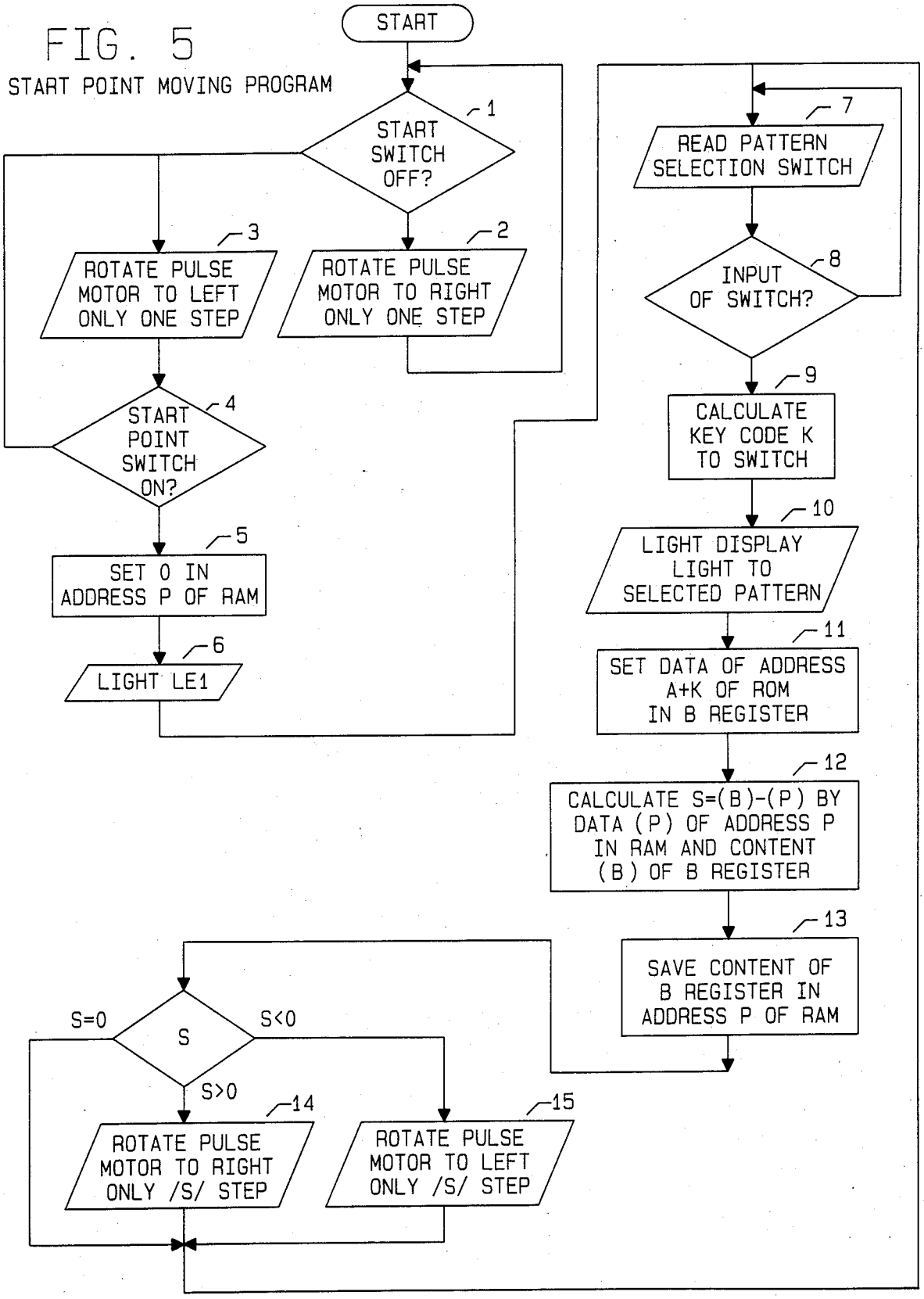
FIG. 5 shows flow chart for explaining the machines in FIGS. 1 and 5.

The operation mode of the present embodiment is explained by the flow chart in FIG. 5. In the present embodiment, the number of cams 1*a*, 1*b*, 1*c*, . . . , cam-followers 4*a*, 4*b*, 4*c*, . . . and pattern switching cams 6*a*, 6*b*, 6*c*, . . . are respectively five.

(1) When supply power is switched on, the start point moving program as shown in FIG. 5 is performed. That is, the condition of the start point switch 21 is read through the input output port I/O. Then the start point switch 21 takes out the condition of a switch-on or off by the position of the lever 21*a* contacted with the small diameter portion 17*a* or the large diameter portion 17*b* of the start point cam 17.

(2) Next if the start point switch 21 is switched on, the pulse motor 20 is rotated to the right only one step. Because the reduction ratio of the pulley of the pulse motor 20 to the timing pulley 18 is for example 1/5, the rotational angle of the one step of the pulse motor 20 is 1.8° in the concrete and then the rotational angle of the start point switch cam 17 is 1.8°/5=0.36°. Until the start point switch 21 is switched off, the pulse motor 20 is rotated to the right by one step after the start point switch 21 is checked by one step.

As stated above, the condition of the start point switch 21 is read through the input output port I/O and the start point switch 21 is checked whether switched on or not.

(3) When the start point switch 21 is switched off, the pulse motor 20 is rotated to the left by one step.

(4) This condition of the start point switch 21 is read through the input output port I/O, and the start point switch 21 is checked whether switched on or not. If the start point switch 21 is switched off, the operation is again jumped to the above (3).

(5) When the start point switch 21 becomes on, this position becomes the start point. The start point switch cam 17 is attached to the pattern switching shaft 16 in this position so that the pattern cam of the straight sewing in the patterns as shown in the table of FIG. 6 is selected. In this position, the position data of the pattern cam is "0".

(6) "0" is written into the P address of the random access memory RAM for respectively memorizing the present position data of the pattern switching cams.

(7) The first display light (for example light emitting diode) of the pattern selection display device 23 corresponding to the start point switch cam 17 is lit by the data of (6).

(8) In FIG. 5, when the start point moving program is performed, the central processing unit CPU checks whether any one of the pattern selection switches 22 is pushed and switched on or not and then waits until any one of the pattern selection switches 22 is pushed.

(9) When any one of the pattern selection switches is selected, a key-code corresponding to the pushed pattern selection switch is calculated. For example, in the table of FIG. 6, when the pattern selection switch SW9 is pushed for sewing a rickrack pattern, this key code is K=8. The key codes corresponding to the pattern selection switches are calculated as shown in the table of FIG. 6. One method for generating the key codes corresponding to the pattern selection switches 22 is that a switch matrix is composed, the switches of the switch matrix are read in turn and are once memorized in the random access memory. Then the respective proper key codes corresponding to the switches are calculated by the memorized data. This method is described in detail in Japanese public inspection laid open Patent Publication No. 20194/1984 proposed by the present inventor.

(10) The display light LED of the pattern selection display device 23 corresponding to the selected switch of the pattern selection switches is lit by the key code. For example the key code K is 8 and the display light LE9 is lit. The method for lighting the display lights is described in detail in the above Japanese public inspection laid open Patent Publication No. 20194/1984.

(11) Next to the address A of the random access memory RAM (the head address of the positions of the pattern switching cams 6*a*, 6*b*, 6*c*, . . . memorized in the random access memory RAM), the positions of the pattern cams as shown in FIG. 6 are memorized in the random access memory RAM. Next the data of the address (A+K) of the random access memory RAM is read in a B register.

(12) S=(B)−(P) is calculated by the data (P) of the address P in the random access memory RAM and the data (B) of the new cam position read in the above program (11).

(13) The contents (B) of the B register are written in the address P in the random access memory RAM.

(14) If S=0, this program is jumped to step (8).

(15) If S>0, the pulse motor 20 is rotated to the right only one pulse and this program is jumped to step (8).

(16) If S<0, the pulse motor 20 is rotated to the left only |S| and this program is jumped to step (8).

For example, if the rickrack pattern is sewn, the position data of the pattern cam is shown by 450 in the table of FIG. 6, and since the rotational ratio of the pattern switching shaft 16 to the pulse motor 20 is reduced to 1/5, the position from the start point where the pattern switching cams 6 generate the rickrack pattern becames $1.8\times450\times1/5=162°$, thus when the pattern switching cams 6 are rotated by 162°, the rickrack pattern is generated.

Therefore, when any one of the pattern selection switches 22 is switched on, a feedback signal need not be applied to the pulse motor 20, the pulse number calculated by the key code is applied to the pulse motor 20 and the pattern cam corresponding to the selected switch of the pattern selection switch 22 is instantaneously selected.

Figure 7:
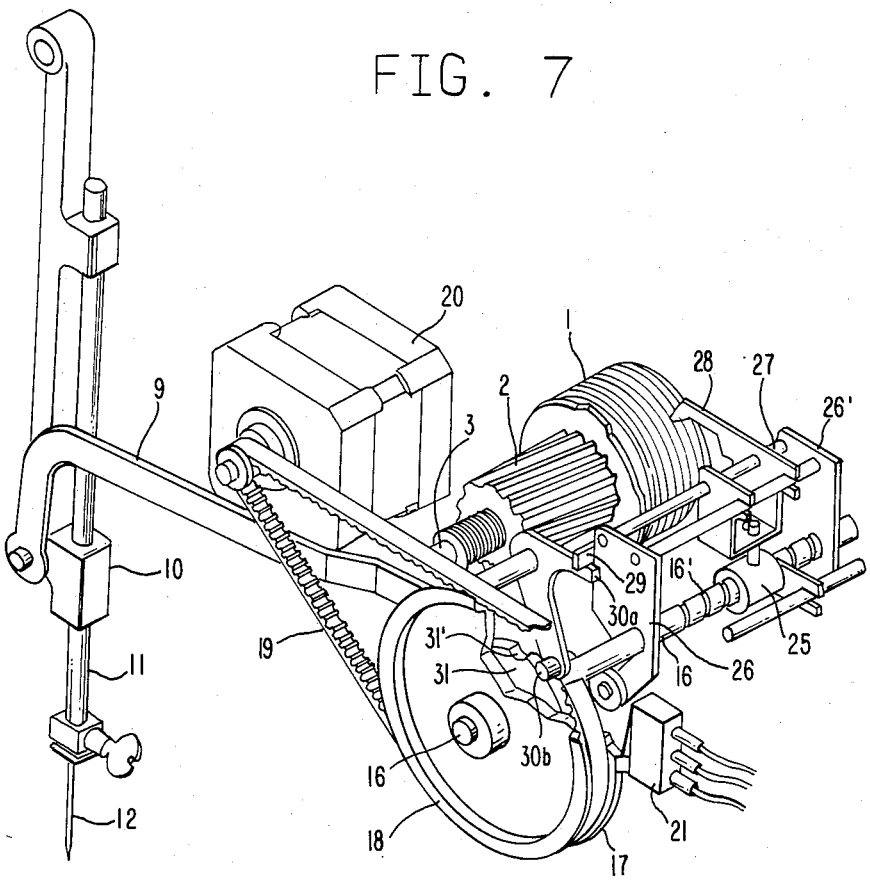
FIG. 7 shows a perspective view of a cam-using electronic control sewing machine of the second embodiment of the present invention.

FIG. 7 is a perspective view of the second embodiment according to the present invention. In FIG. 7, 1 denotes a plurality of pattern cams, 2, a worm wheel, 3, a rotary shaft, 9, a needlebar guide rod, 10, a needlebar guide, 11, a needlebar, 12, a needle, 16, a pattern switching shaft, 18, a timing pulley, 19, a timing belt, 20, a pulse motor and 21, a start point switch, and since the same numerals denote similar parts as in FIG. 1, a detailed explanation of these constitutions is omitted. In the present embodiment, a cam-follower guide 25 is attached to the pattern switching shaft 16. When the timing pulley 18 and the pattern switching shaft 16 are rotated by the rotation of pulse motor 20, the cam-follower guide 25 is moved to right or left by the rotation of the pattern switching shaft 16, because the projection provided inside the cam-follower guide 25 is inserted into the spiral groove 16' on the surface of the pattern switching shaft 16. Two parallel rotary boards 26 and 26' are rotation-freely attached to the pattern switching shaft 16 apart from the cam-follower guide 25. The rotary boards 26 and 26' correspond to the Z-arm 7 in FIG. 1 and the lower portion of the rotary board 26 is connected to one end of the needlebar guide rod 9. A cam follower 28 is supported by a support member 27, both ends of which are attached to the rotary boards 26 and 26'. The lower portion of the cam-follower 28 is connected to the cam-follower guide 25 and is moved with the guide 25. An upper projection 29 of the rotary board 26 is contacted with for upper portion 30*a* of a converse L-like stop lever 30. A central portion of the stop lever 30 is supported by a rotary shaft and a lower portion 30*b* thereof is engaged with dents 31' of a stop cam 31, which correspond to the plural pattern cam 1.

In this embodiment, after the start point moving program is performed, a key code is calculated by reading the data of the selected pattern selection switches 22 and the pulse motor 20 is driven by the key code. This operation is the same as in the embodiment of FIG. 1, but when the pulse motor 20 is driven and the timing belt is rotated, the stop cam 30 is rotated therewith. By the rotation of the stop cam 30, the projection 30*b* of the stop lever 30 is slipped out of the hollow of the dents 31', the upper portion 30*a* of the stop lever 30 is lifted, the projection 29 of the rotary board 26 is lifted by the upper portion 30*a* and the cam-follower 28 is not contacted with the plural pattern cams 1. By the rotation of the patterns switching shaft 16, when the cam-follower 28 is brought on the selected pattern cam, the projection 30*b* of the cam-follower 28 is contacted with the hollow of the dents 31' and the cam follower 28 is contacted with the selected cam of the pattern cams. When the cam-follower 28 is contacted with the pattern cams, the needlebar guide rod 9 and the needlebar 11 are moved and the desired pattern is sewn.

Therefore, a feedback signal need not be applied to the pulse motor 20, the cam-follower 28 is surely positioned with respect to the pattern cam selected by the pattern selection switch 22 and the construction of this embodiment is very simple.

Figure 8:
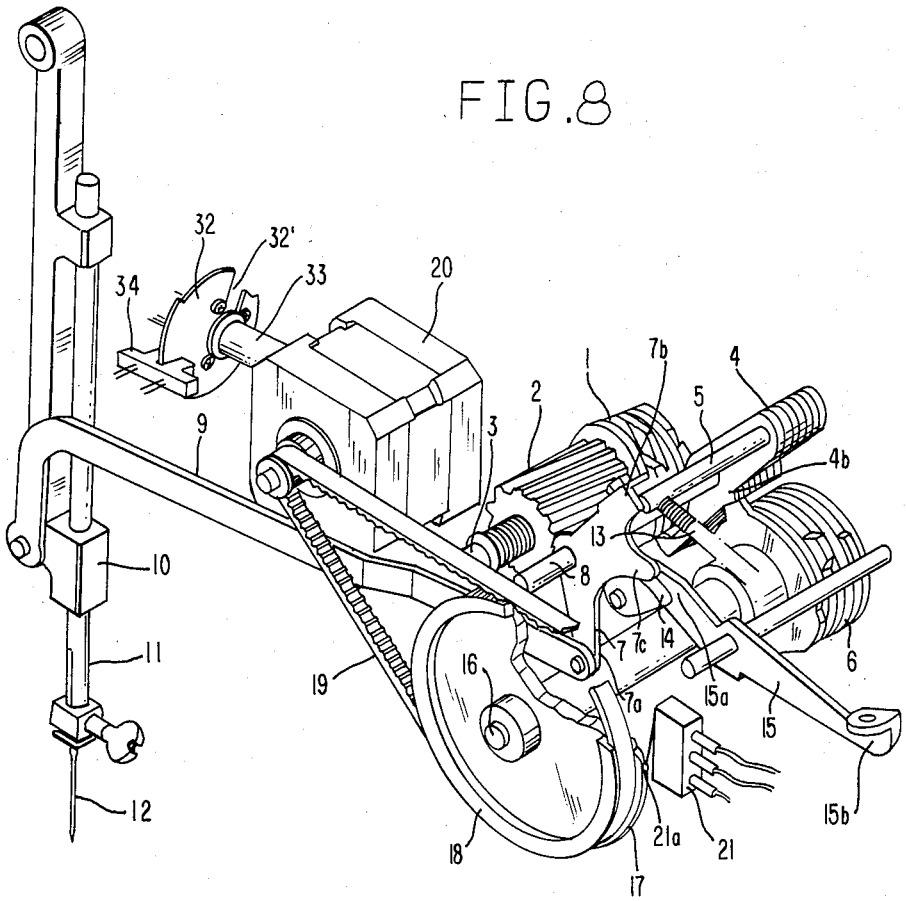
FIG. 8 shows a perspective view of a cam-using electronic control sewing machine of the third embodiment of the present invention.

FIG. 8 is a perspective view of cam-using electronic control sewing machine for sewing button hole stitches of the third embodiment according to the present invention. In FIG. 7, 1 denotes a plurality of pattern cams for sewing button hole stitches, 2, a worm wheel, 3, a rotary shaft, 9, a needlebar guide rod, 10, a needlebar guide, 11, a needlebar, 12, a needle, 16, a pattern switching shaft, 17, a start point switch cam, 18, a timing pulley 19; a timing belt, 20, a pulse motor and 21, a start point switch, and since the same numerals denote similar parts as in FIG. 1, a detailed explanation of these constitutions is omitted. In the present embodiment, a disk 32 having a slit 32' is mounted on a main shaft 33 and is inserted between a light emitting diode and a phototransistor of a timing sensor 34.

Figure 9:
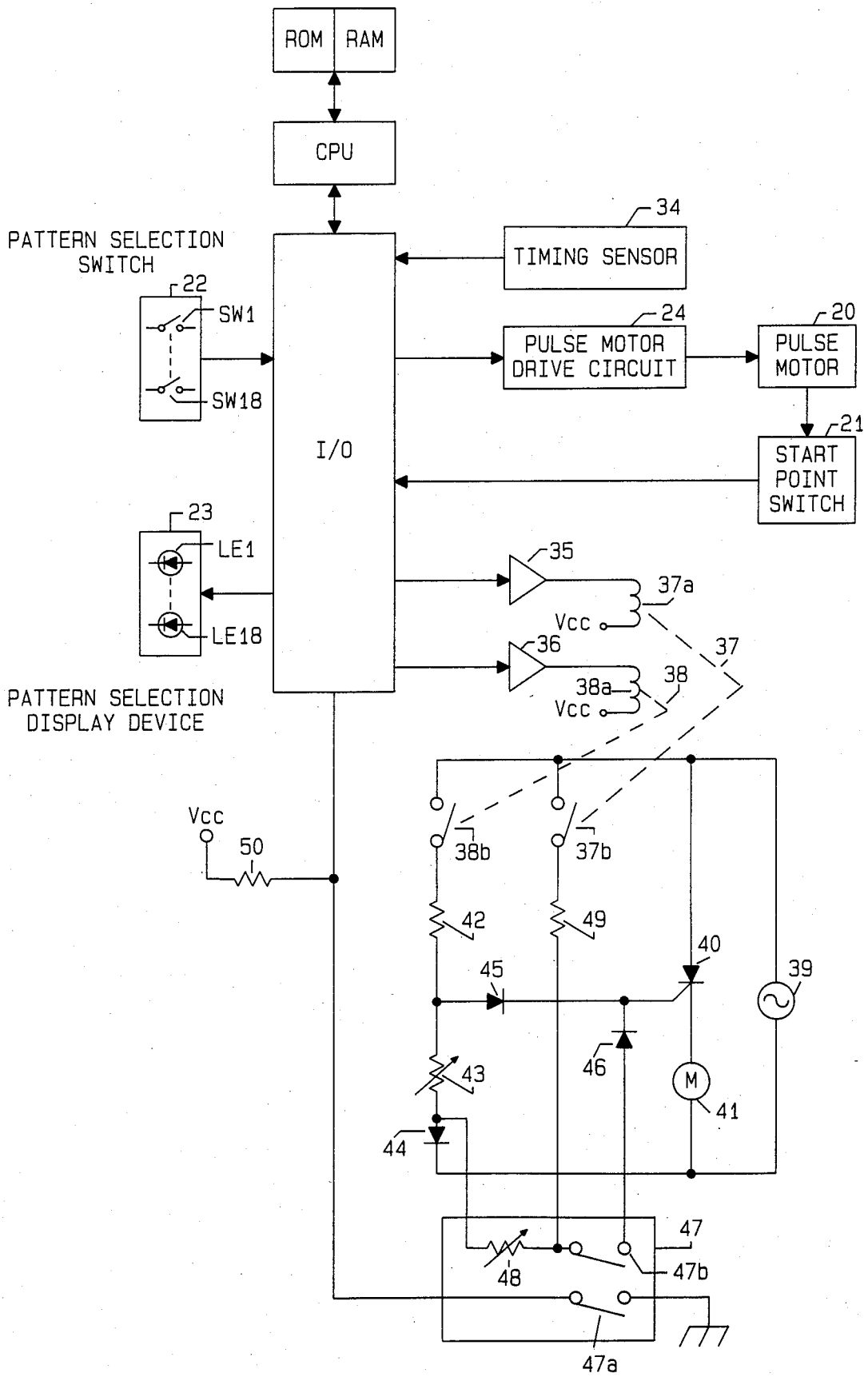
FIG. 9 shows a control circuit for controlling the motion of the cam-using electronic control sewing machine in FIG. 8.

FIG. 9 is a control circuit for controlling the sewing machine of FIG. 8. In FIG. 9, a microcomputer having a central processing unit CPU, a read only memory ROM, a random access memory RAM and a input output port I/O is used. A pattern selection switch 22 and a pattern selection display device 23 which are mounted on a panel of the sewing machine, a pulse motor drive circuit 24 for driving the pulse motor 20 and the start point switch 21 are connected to the input output port I/O. Also, coils 37*a* and 38*a* of relays 37 and 38 are respectively connected through buffers 35 and 36 to the input output port I/O.

Also, a series circuit having an SCR 40 and motor 41 and a series circuit having a contact 38*b* of the relay 38, a resistor 42, a semi-variable resistor 43 and a diode 44 are connected to a power supply 39 in parallel. A diode 45 is connected between the connecting point of the resistor 42 with the semi-variable resistor 43 and the gate terminal of the SCR 40, which is connected through a diode 46 to one end of a second switch 47*b* of a foot-controller 47. The other end of the second switch 47*b* is connected through a variable resistor 48 to a connecting point between the semi-variable resistor 43 and the diode 44 and through a resistor 49 to one end of the contact 37*b* of the relay 37, the other end of which is connected to the power supply 39. One end of a first switch 47*a* of the foot-controller 47 is connected to the input output port I/O and through a resistor 50 to a power supply Vcc and the other end of the first switch 47*a* is connected to ground.

When "0" and "1" are applied from the input output port I/O to the buffers 35 and 36, an electric current flows in the coil 37*a* of the relay 37 and does not flow in the coil 38*a* of the relay 38. Therefore, the contact 37*b* is closed and contact 38*b* is opened. When "1" and "0" are applied from the input output port I/O to the buffers 35 and 36, electric current flows in the coil 38*a*, and thus the contact 37*a* is opened and contact 38*b* is closed. When the foot-controller 47 is pushed, the contacts 47*a* and 47*b* thereof are switched on and the resistance value of the variable resistor 48 is increased. When the foot-controller 47 is not pushed, the resistance value of the variable resistor 48 becomes small and the contacts 47*a* and 47*b* are switched off.

When the contact 37*b* of the relay 37 is switched on, the contact 38*b* of the relay 38 is switched off and when the foot-controller 47 is not pushed, the contact 47*b* of the footcontroller 47 is switched off and an electric current does not flow in the gate terminal of the SCR 40. Therefore, the SCR 40 is not turned on, electric power is not applied to the motor 41 and thus the motor 41 is not rotated.

When the foot-controller 47 is pushed, the contacts 47*a* and 47*b* are switched on, the voltage divided by the resistor 49 and the variable resistor 48 is applied to the gate terminal of the SCR 40. Thus, the SCR 40 is turned on and the motor 41 is rotated by supply of the electric power. When the foot-controller 47 is more strongly pushed, the resistance value of the variable resistor 48 is increased, the voltage applied to the gate terminal of the SCR 40 becomes high, the conductive angle of the SCR 40 becomes large and the rotation of the motor 41 becomes high. Therefore, the speed of the motor 41 is freely controlled by the pushing strength of the foot-controller 47.

When the contact 37*b* of the relay 37 is switched off and the contact 38*b* of the relay 38 is switched on, the voltage divided by the resistor 42 and the semi-variable resistor 43 is applied to the motor 41 and then the semi-variable resistor 43 is so adjusted so that the rotation speed of the motor 41 becomes constant.

Figure 10:
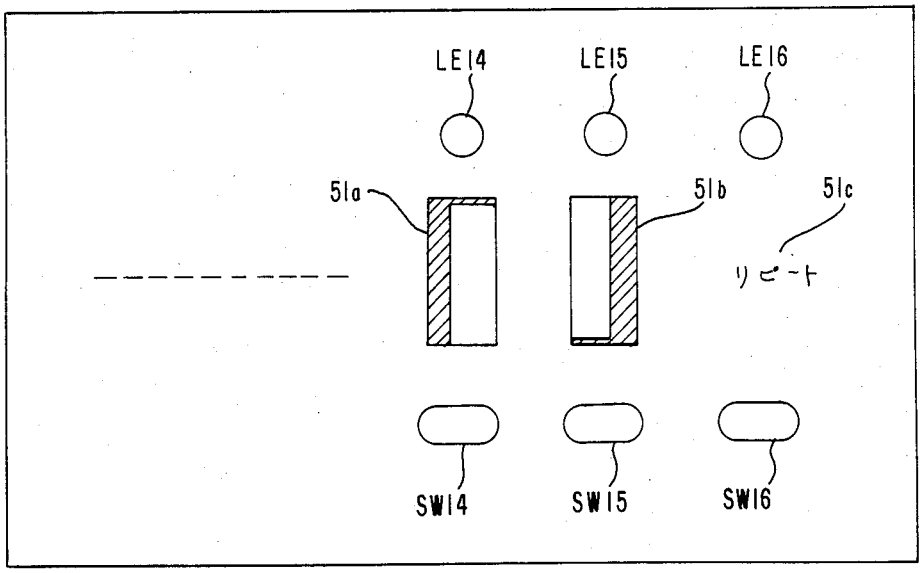
FIG. 10 shows a plane view of a machine operation panel according to the present invention.

FIG. 10 is an plane view of operation panel of the sewing machine of the present invention. The patterns corresponding to the pattern in the table of FIG. 6 are illustrated on the center of the panel in FIG. 10, but the other patterns are omitted and patterns 51*a* and 51*b* of the button hole and pattern 51*c* of a repeat are described. The light emitting diodes LE14, LE15 and LE16 of the display device 23 are attached to the panel above the patterns 51*a*,51*b* and 51*c* and the switches SW14, SW15 and SW16 of the pattern selection switches 22 are attached to the panel lower an the patterns 51*a*, 51*b* and 51*c*.

Figure 11:
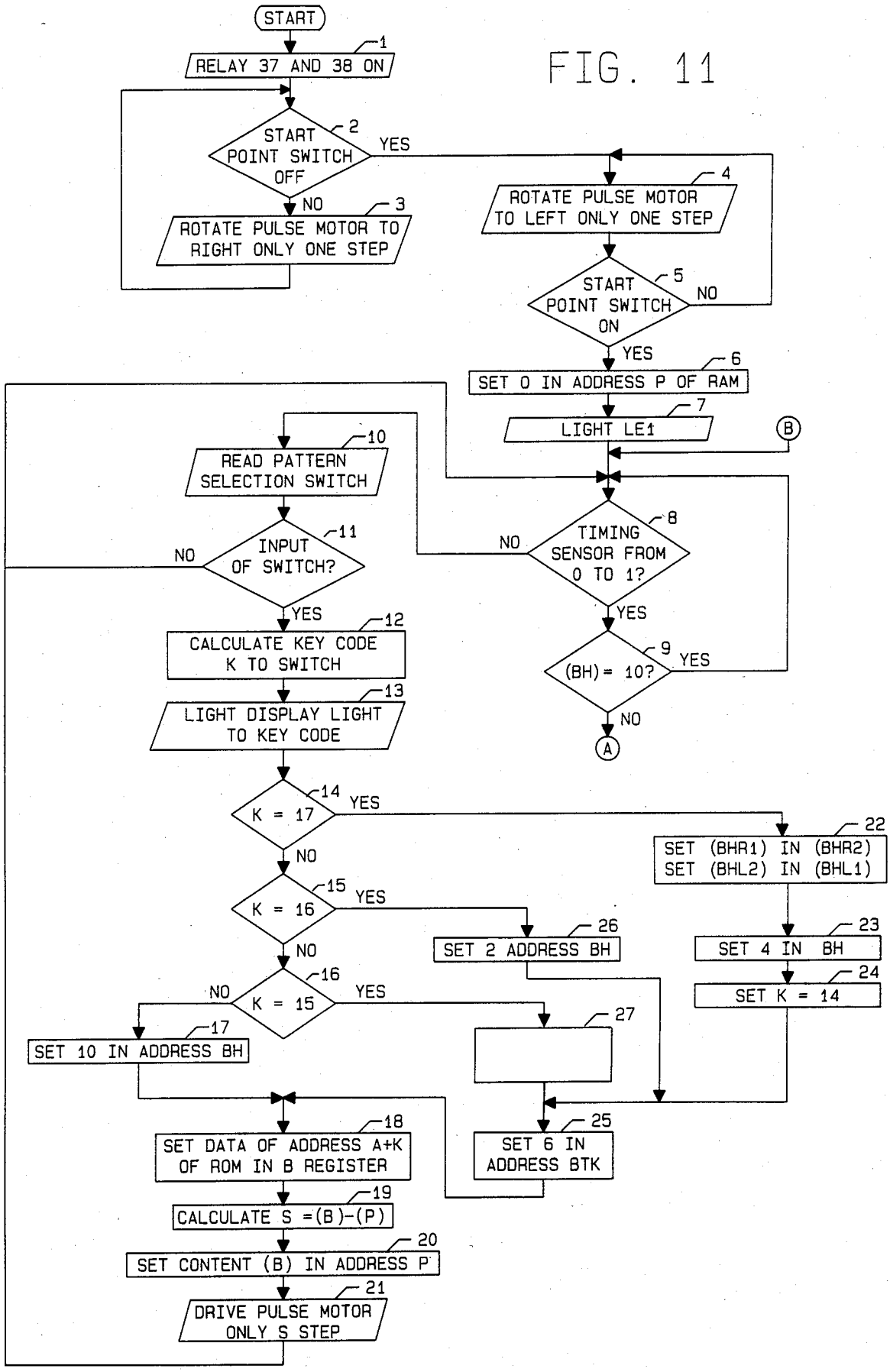
FIGS. 11, 12 and 13 show flow charts for explaining the motions of the machine in FIGS. 8 and 9.

The operation mode of the present embodiment is explained by the flow chart in FIG. 11. When the electric power is supplied, the start point moving program as shown in FIG. 11 is executed.

(1) The condition of the start pont switch 21 is read through the input output port I/O and then the start point switch 21 generates the condition of switch-on or off by the position of the small diameter portion 17*a* or the large diameter portion 17*b* of the start point switch cam 17.

(2) Next the switch-on or off of the start point switch 21 is decided.

(3) If the start point is switched on, the pulse motor 20 is rotated to the right only one step. Because the reduction ratio of the pulse motor 20 to the timing puley 18 is for example 1/5, the rotational angle of the one step of the pulse motor 20 is 1.8° in the concrete and then the rotational angle of the start point switch cam 17 is 1.8°/5=0.36. Until the start point switch 21 is switched off, the pulse motor 20 is rotated to the right by one step after the start point switch 21 is checked one by one. The condition of the start point switch 21 is read through the input output port I/O and is checked whether switched on or not.

(4) When the start point switch 21 is switched off, the pulse motor 20 is rotated to the left only one step.

(5) This condition of the start point switch 21 is read through the input output port I/O, and the start point switch 21 is checked whether switched off or not. If the start point switch 21 is switched off, this operation is again jumped to the above (4). When the start point switch 21 becomes switched on, this position becomes the start point. The start point switch cam 17 is attached to the pattern switching shaft 16 in this position so that the pattern cam of the straight stitch sewing in the patterns in the table of FIG. 6 is selected. In this point, the position data of the pattern cam is "0".

(6) "0" is written into the address P and "10" is written into the address BH of the random access memory RAM for respectively memorizing the present position of the pattern switching cams.

(7) The first display light (for example a light emitting diode) of the pattern selection display device 23 corresponding to the start point switch cam 17 is lighted by this data.

(8) In FIG. 11, When the start point moving program is performed, the output from the timing sensor 34 is read through the input output port I/O and whether this output is changed from "0" to "1" or not is detected.

(9) When this output is changed from "0" to 37 1", the data (BH) of the address BH of the random access memory RAM is checked. If this data (BH)=10, this program is jumped to the above (8). If the data (BH)≠0, this program is jumped to the program of FIG. 12 and the button hole sewing program is performed.

(10) The condition of the pattern selection switches 22 is read through the input output port I/O into the random access memory RAM.

(11) The input of the pattern selection switches 22 is checked by the read data of the random access memory RAM. If the input is not applied from the pattern selection switch, this program is jumped to (8).

(12) A key code corresponding to the selected pattern selection switches 22 is calculated.

(13) A display light of the pattern selection display device 23 corresponding to the key code is lighted.

(14) Whether K=17 or not, that is whether the repeat switch SW18 is pushed or not is checked. If K=17, this program is jumped to (22).

(15) Whether K=16 or not, that is whether the button hole selection switch SW17 is pushed or not is checked. If K=16, this program is jumped to (26).

(16) Whether K=15 or not, that is whether the button hole selection switch SW16 is pushed or not is checked. If K=15, this program is jumped to (27).

(17) "10" is set in the address BH of the random access memory RAM.

(18) The position data of the pattern cam memorized in the address (A+K) of the random access memory RAM is set in the register B.

(19) The data of the address P of the random access memory RAM, in which the cam position data of the selected pattern cams are memorized, are subtracted from the contents of the register B, and this difference S is calculated.

(20) The contents (B) of the register B are written in the address P of the random access memory RAM.

(21) The pulse motor is rotated by the step S (when S>0, to the right and when S<0, to the left) and then this program is jumped to (8).

(22) The contents of the addresses BHR1 and BHL1 of the random access memory RAM are respectively memorized in the addresses BHR2 and BHL2 of the random access memory RAM.

(23) "4" is set in the address BH of the random access memory RAM.

(24) The key code K=14 is set.

(25) "6" is set in the address BTK of the random access memory RAM and then this program is jumped to (18).

As stated above, when the repeat switch 18 is pushed, the light emitting diode of the display device 23 is lighted and the pattern cam for sewing the bar tacking stitches of the button hole is selected.

(26) "2" is set in the address BH of the random access memory RAM and then this program is jumped to (25).

(27) "0" is set in the address BH of the random access memory RAM and then this program is jumped to (25).

Figure 12:
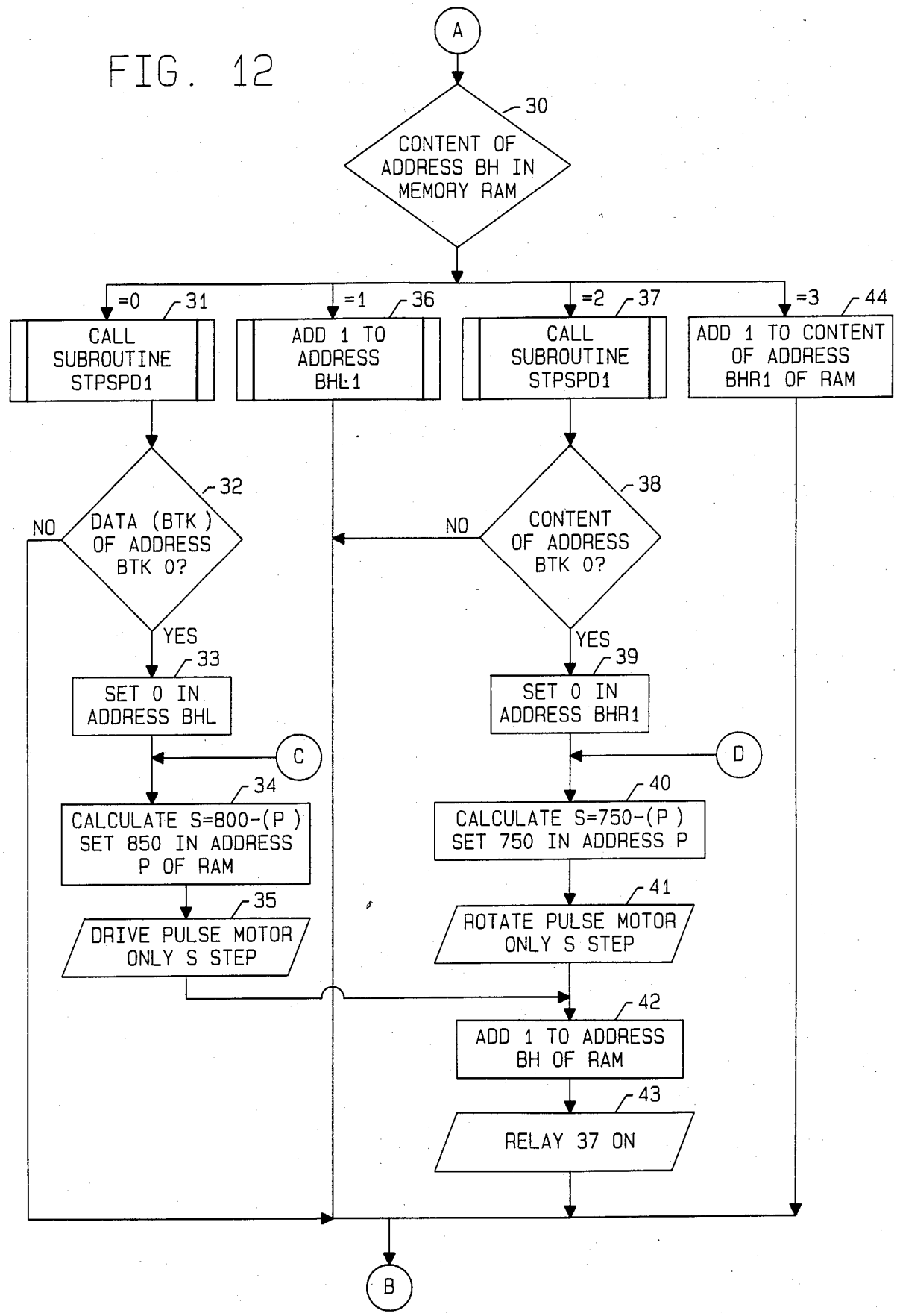
Figure 13:
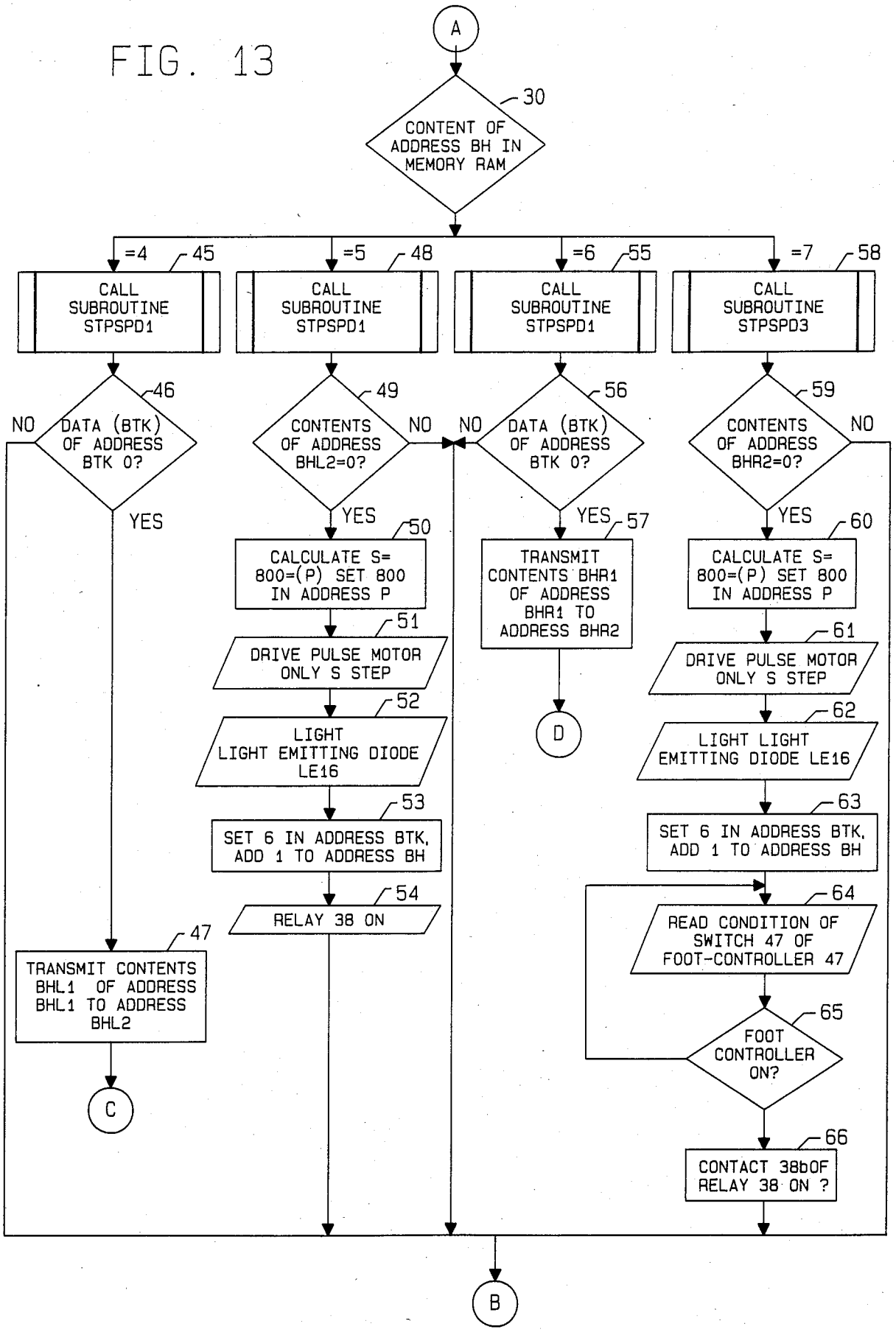

The next operation is explained by FIGS. 12 and 13. (30) the contents of the address Bh of the random access memory RAM are checked and this program is jumped to the respective programs by the respective values of the address BH.

(I) (BH)=0

In this program, when a trial sewing is performed, the number of the bar tacking stitches is counted, the rotation of the motor is decreased to a low speed at five tacking stitches and is stopped at six tacking stitches and the pattern cam of the left line tacking stitches is selected.

(31) A subroutine "STPSPD1" is called.

(32) The data (BTK) of the address BTK of the random access memory RAM are checked, if (BTK)≠0, this program is jumped to (B).

(33) If (BTK)=0, "0" is set in the address BHL1 of the random access memory RAM.

(34) The data of the address P of the random access memory RAM are subtracted from the cam position data "850" (see FIG. 14) of the left line tacking stitches and this difference S is calculated. Then "850" is set in the address P.

(35) The pulse motor is rotated by S steps and the left line tack cam is selected.

(42) "1" is added to the address BH of the random access memory RAM.

(43) When the relay 37 is switched on. By this, the rotation of the motor 41 is controlled by the pushing amount of the foot-controller.

(II) BH=1

In this program, "1" is added to the contents in the address BHL1 of the random access memory RAM every one stitch. That is, since the number of left line tacking stitches is counted, an operator can change the length of the left line tacking stitches.

(36) "1" is added to the contents of the address BHL1 of the random access memory RAM and then this program is jumped to (B).

(III) BH=2

Figure 14:
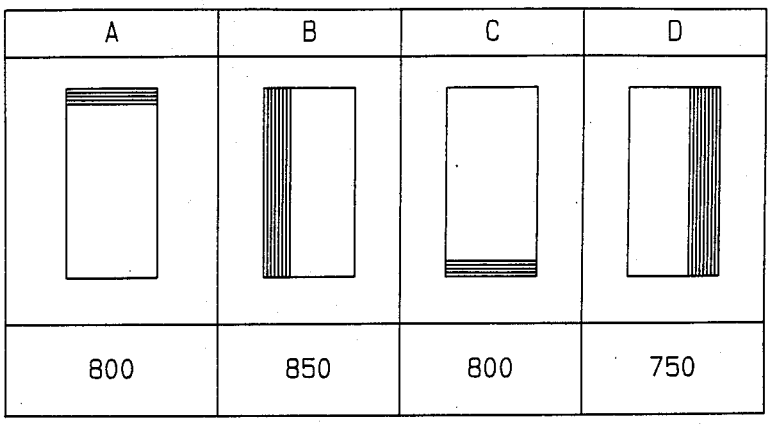
FIG. 14 shows 4 processes for sewing button holes and cam position data for the patterns of the button holes.

This is a program for controlling the sewing of bar tacking stitches of (c) in FIG. 14 when the trial sewing in FIG. 12 is performed.

(37) A subroutine "STPSPD" (see FIG. 15) is called.

(38) The contents (BTK) of the address BTK of the random access memory RAM are checked and if (BTK)≠0, this program is jumped to (B).

(39) If (BTK)=0, "0" is set in the address BHR1 of the random access memory RAM.

(40) The contents of the address P of the random access memory RAM is subtracted from the cam position data "750" and this difference S is calculated. "750" is set in the address P of the random access memory RAM.

(41) The pulse motor is driven only S steps and then this program is jumped to (42).

(IV) BH=3

In this program, the number of the right line tacking stitches is counted.

(44) "1" is added to the contents of the address BHR1 of the random access memory RAM and then this program is jumped to (B).

(V) BH=4

In this program, the number of the bar tacking stitches is counted in the repeat mode and the right line tack cam is selected when six stitches is sewn.

(45) The subroutine "STPSPD1" is called.

(46) The contents (BTK) of the address BTK of the random access memory RAM is checked whether 0 or not and if (BTK)≠0, this program is jumped to (B).

(47) If (BTK)=0, the contents (BHL1) of the address BHL1 in the random access memory RAM is transmitted to the address BHL2 in the random access memory RAM and then this program is jumped to (C).

(VI) BH=5

In this program, the left line tack is sewn by the number of the tacking stitches memorized by the program in (BH)=1, then the motor 41 is stopped and the bar tack cam of (c) in FIG. 14 is selected.

(48) A subroutine "STPSPD2" is called.

(49) The contents of the address BHL2 of the random access memory RAM is dchecked and if (BHL2)≠0, this program is jumped to (B).

(50) The cam position data of the address P of the random access memory RAM are subtracted from the position data "800" of the bar tack cam and this difference S is obtained. "800" is set in the address P of the random access memory RAM.

(51) The pulse motor is drived by S steps and the bar tack cam is selected.

(52) The light emitting diode LE16 of the display device 23 is lighted.

(53) The number "6" of the bar tacking stitches is set in the address BTK of the random access memory RAM and "1" is added to the contents of the address of the random access memory RAM.

(54) The relay 38 is switched on and then this program is jumped to (B).

(VII) BH=6

This is a program for sewing of the bar tacking stitches of (c) in FIG. 14 in the repeat mode. After this program is performed, the right line tack cam is selected.

(55) The subroutine "STPSPD1" is called.

(56) The contents (BTK) of the address BTK of the random access memory RAM and if (BTK)≠0, this program is jumped to (B).

(57) The contents (BHR1) of the address BHR1 of the random access memory RAM is transmitted to the address BHR2 and then this pogram is jumped to (D).

(VII) BH=7

In this program, the right line tacking stitches is sewn only the number of a trail sewing, then the motor 41 is automatically stopped and the bar tack cam is so selected that the bar tacking stitches is sewn from its beginning.

(58) A subroutine "STPSP3" is called.

(59) The contents (BHR2) of the address BHR2 of the random access memory RAM is checked and if (BHR2)≠0, this program is jumped to (B).

(60) The contents of the address P of the random access memory RAM is subtracted from the position data "800" and its difference is obtained. Then "800" is set in the address P of the random access memory RAM.

(61) The pulse motor 20 is driven only the S steps.

(62) The light emitting diode LE14 of the display device is lighted.

(63) "6" is set in the address BTK of the random access memory RAM and "4" is set in the address BH of the random access memory RAM.

(64) The condition of the switch 47*a* of the foot-controller 47 is read.

(65) If the switch 47 is switched on (the foot-controller is pushed), this program is jumped to (64). Then this program goes on waiting until the foot-controller 47 is not pushed.

(66) The contact 37*b* of the relay 37 is switched on and this program is jumped to (B).

Figure 15:
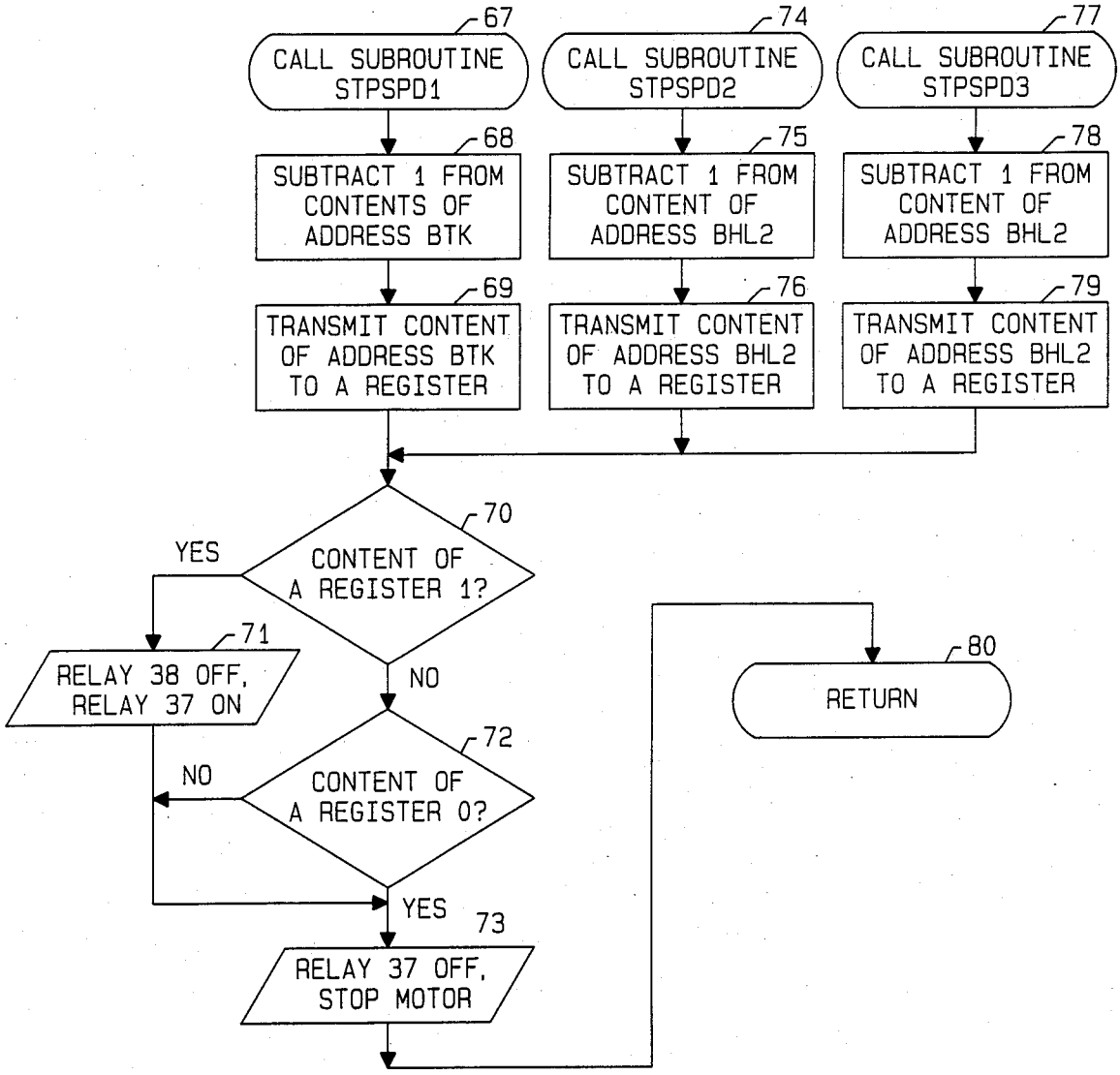
FIG. 15 shows a flow chart of a subroutine.

FIG. 15 is a flow chart for explaining the subroutine.

(I) Subroutine "STPSPD1" (67)

This is a subroutine for checking whether the bar tack stitches of (a) and (c) of FIG. 14 in the button hole sewing are sewn or not. Since (BHK)=6 is first set, When (BH)=1, the speed of the motor 41 is decreased in a low speed and when (BHK)=0, the motor 41 is stopped. "1" is subtracted from the contents (BHK) every one stitch.

(68) "1" is subtracted from the contents of the address BTK of the random access memory RAM.

(69) The contents of the address of the random access memory RAM are transmitted to the register A.

(70) The contents of the register A are checked whether "1" or not and if the contents are "1", this program is jumped to (72).

(71) The relay 38 is switched off, the relay 37 is switched on and the sewing machine is driven in a predetermined constant rotation by adjusting the semi-fixed resistor 43.

(72) The contents of the register A are checked whether "0" or not.

(73) The relay 37 is switched off, the motor 41 is stopped and this program is returned.

(II) Subroutine "STPSPD2" (74)

This is a subroutine for stopping the motor when the number of the left line tacking stitches of (b) in FIG. 14 is equal to that of the first trial sewing and for rotating the motor at a constant speed when the number of the left line tacking stitches is only one stitch short in the repeat mode of the button hole sewing.

(75) "1" is subtracted from the contents of the address BHL2 of the random access memory RAM.

(76) The contents of the address BHL2 of the random access memory RAM are transmitted to the register A and then this program is jumped to (70).

(III) Subroutine "STPSPD3" (77)

This is a subroutine for stopping the motor when the number of the right line tacking stitches of (d) in FIG. 14 is equal to that of the first trial sewing and for rotating the motor at a constant speed when the number is only one stitch short in the repeat mode of the button hole sewing.

(78) "1" is subtracted from the contents of the address BHR2 of the random access memory RAM.

(79) The contents of the address BHR2 of the random access memory RAM are transmitted to the register A and then this program is jumped to (70).

As stated above, when the foot-controller is pushed in the repeat mode, a number of plural button hole stitches are automatically sewn equal to the number of the tacking stitches in the trial sewing.

Relating to a change of a cloth moving, when the bar tack cam (the position data of the pattern cam are 800) is selected, the angle of a cloth moving adjuster is controlled by a moving cam fixed on the pattern switching cam shaft so that the amount of the cloth moving becomes 0. Also, when the cam of the left line tacking stitches (the data of the pattern cam is 850) is selected, the moving cam is rotated and a cloth is moved to the advance direction and when the cam of the right line tacking stitches is selected, the moving cam is rotated and the cloth is moved opposite direction.

What is claimed is:

1. A cam-using electric control sewing machine comprising a plurality of pattern cams rotated by a rotation of a main shaft, one or more cam-followers for contacting with said plurality of pattern cams, a needlebar guiderod and a needle bar connected with the moving of said cam-follower, a position setting device for setting positions of said cam-followers, a start point detecting device for detecting a start point of the cam position data of said pattern cams, a pulse motor for causing movement of said cam-followers for selectively operating said cam-followers, a drive circuit for driving said pulse motor, a plurality of pattern select switches for generating one of proper key codes when one of a plurality of sewing patterns is selected, a display device for displaying the selection of one of said sewing patterns, a memory for storing data corresponding to said starting point of the pattern cams, a random access memory for memorizing data of the position of the cam selected at present, and an operational unit for calculating the number of output pulses applied to said pulse motor by the cam position data selected at present in said random access memory and the proper key codes generated by said pattern selection switch, whereby said output pulses are applied to said pulse motor and the desired sewing patterns are selected.

2. A cam-using electric control sewing machine as claimed in claim 1, wherein said start point detecting device includes a cam having a half portion of a large diameter and a half portion of a small diameter and a switch contacted with said cam.

3. A cam-using electric control sewing machine as claimed in claim 1, furthermore comprising a pulse generator for generating pulses by the rotation of said main shaft, a counter for counting the number of pulses from said pulse generator, a control circuit for performing a repeat mode by the count number of said counter, and a motor control circuit having a foot-controller for controlling a motor for rotating said main shaft, said motor control circuit being connected to said control circuit.

4. A cam-using electric control sewing machine as claimed in claim 3, wherein said pulse generator includes a disc having a slit connected to said main shaft and a timing sensor having a light emitting diode and a phototransistor.

* * * * *